US009694375B2

(12) United States Patent
Boulais

(10) Patent No.: US 9,694,375 B2
(45) Date of Patent: Jul. 4, 2017

(54) FLUID DISPENSING DEVICE AND METHOD FOR PRODUCING SUCH A DEVICE

(71) Applicant: GB DEVELOPPEMENT, Puteaux (FR)

(72) Inventor: Guillaume Boulais, Levallois Perret (FR)

(73) Assignee: GB DEVELOPPEMENT, Vernon (FR)

( * ) Notice: Subject to any disclaimer, the term of this patent is extended or adjusted under 35 U.S.C. 154(b) by 0 days.

(21) Appl. No.: 14/765,181

(22) PCT Filed: Jan. 28, 2014

(86) PCT No.: PCT/EP2014/051656

§ 371 (c)(1),
(2) Date: Jul. 31, 2015

(87) PCT Pub. No.: WO2014/122048

PCT Pub. Date: Aug. 14, 2014

(65) Prior Publication Data

US 2015/0375244 A1 Dec. 31, 2015

(30) Foreign Application Priority Data

Feb. 7, 2013 (FR) ..... 13 51070

(51) Int. Cl.
*B05B 11/04* (2006.01)
*B05B 11/00* (2006.01)

(52) U.S. Cl.
CPC ..... *B05B 11/047* (2013.01); *B05B 11/007* (2013.01); *B05B 11/0018* (2013.01);
(Continued)

(58) Field of Classification Search
CPC ..... B05B 11/047; B05B 11/0075; B05B 11/3032; B05B 11/3064; B05B 11/007; B05B 11/0018
(Continued)

(56) References Cited

U.S. PATENT DOCUMENTS 3,507,586 A * 4/1970 Kutik ..... B05B 11/3032 137/855
3,715,060 A * 2/1973 Benson ..... A47G 19/183 222/207

(Continued)

FOREIGN PATENT DOCUMENTS

| | | | | |
|---|---|---|---|---|
| DE | 102008030278 | A1 | 9/2009 | |
| EP | 0 457 245 | A2 | 5/1991 | |
| EP | 1 974 830 | A1 | 10/2008 | |
| FR | 2 542 820 | A1 | 9/1984 | |
| FR | 2 554 088 | A1 | 5/1985 | |
| FR | 2962986 | A1 * | 1/2012 | ..... B05B 11/3032 |
| GB | 2 140 509 | A | 11/1984 | |
| GB | 2 150 226 | A | 6/1985 | |
| WO | WO 96/12904 | A1 | 5/1996 | |

OTHER PUBLICATIONS

International Search Report for corresponding International Application No. PCT/EP2014/051655 mailed Mar. 19, 2014.

*Primary Examiner* — Donnell Long
(74) *Attorney, Agent, or Firm* — Renner, Otto, Boisselle & Sklar, LLP

(57) ABSTRACT

Device for dispensing a fluid, comprising: a feed pipe, a dispensing pipe arranged in order to convey a fluid in a dispensing direction, a deformable pouch, a feed valve, which, in an open state, allows fluid to pass from the feed pipe to the inside of the pouch, and, in a closed state, does not allow this, and a dispensing valve, which, in an open state, allows fluid to pass from the inside of the pouch to the dispensing pipe, and, in a closed state, does not allow this, wherein the dispensing valve is held in the device by tightening between inner walls of the dispensing pipe.

20 Claims, 4 Drawing Sheets

(52) U.S. Cl.
CPC ..... *B05B 11/0075* (2013.01); *B05B 11/3032* (2013.01); *B05B 11/3064* (2013.01)

(58) Field of Classification Search
USPC ..... 222/207, 209, 211, 213
See application file for complete search history.

(56) References Cited

U.S. PATENT DOCUMENTS

| | | | | |
|---|---|---|---|---|
| 5,240,149 | A | 8/1993 | Schmidt | |
| 6,789,706 | B2 * | 9/2004 | Abergel | B05B 11/0043 222/207 |
| 7,032,783 | B1 | 4/2006 | Kamp et al. | |
| 7,806,301 | B1 * | 10/2010 | Ciavarella | B05B 11/3033 222/181.3 |
| 2006/0186139 | A1 * | 8/2006 | Laidler | B05B 11/0027 222/207 |
| 2007/0080177 | A1 * | 4/2007 | Hatton | A47K 5/1208 222/207 |
| 2007/0114247 | A1 * | 5/2007 | Spriegel | A47K 5/1208 222/207 |
| 2007/0158364 | A1 * | 7/2007 | Drennow | B67D 1/0082 222/207 |
| 2008/0035677 | A1 | 2/2008 | Daansen | |
| 2008/0237272 | A1 | 10/2008 | Durant et al. | |

* cited by examiner

FLUID DISPENSING DEVICE AND METHOD FOR PRODUCING SUCH A DEVICE

TECHNICAL FIELD

The present invention relates to a device for dispensing a fluid and a method for manufacturing such a device.

The technical field of the invention is non-limitatively that of dispensing devices for soap, cosmetics, or other substances, for large or small volumes to be dispensed, for example, a device fixed to a wall for dispensing large volumes of soap or also a promotional sample-type device for smaller volumes of cosmetics.

STATE OF THE ART

Devices for dispensing a fluid such as that described in the document FR2962986 are known.

Such a device according to the state of the art is manufactured by introducing a dispensing valve on the side of a deformable pouch arranged in order to be deformed by pressure. The valve in the prior art is thus clipped onto a portion of the pouch, called the rear wall, arranged in order to receive it.

A major drawback of this type of method for manufacturing the device according to the state of the art is that, due to the difficulty of inserting the valve into the device, it can be time-consuming and/or damage the valve during assembly, affecting the sealing of the device.

The purpose of the present invention is to solve at least this problem posed by the state of the art.

DISCLOSURE OF THE INVENTION

Such an objective is achieved with a device for dispensing a fluid (liquid and/or gas), comprising:

- preferably a feed pipe,
- a dispensing pipe arranged in order to convey a fluid in a dispensing direction,
- a deformable pouch,
- preferably a feed valve, which, in an open state, allows fluid to pass from the feed pipe to the inside of the pouch, and, in a closed state, does not allow this, and
- a dispensing valve, which, in an open state, allows fluid to pass from the inside of the pouch to the dispensing pipe, and, in a closed state, does not allow this.

The dispensing valve is preferably held in the device by tightening between inner walls of the dispensing pipe.

More generally, the dispensing valve is preferably held in the device according to the invention by tightening:

- for example by tightening by sliding the dispensing valve along the dispensing pipe,
- more particularly preferably by tightening in the dispensing pipe, typically after a movement or an insertion of the dispensing valve into the dispensing pipe (typically the movement of the dispensing valve in the dispensing pipe creates a material deformation of the dispensing valve or of a joining element integral therewith in order to achieve a tightening of this integral joining element or directly of the dispensing valve).

The dispensing valve is preferably, in its closed state, held pressed against a part (called the dispensing seat) of an inner wall of the dispensing pipe.

Preferably, the dispensing valve can be linked to a joining element, the dispensing valve and the joining element being preferably integral and in a single piece.

The dispensing valve and the joining element are preferably entirely contained in the dispensing pipe.

In the case where the dispensing valve is held in the device by tightening between inner walls of the dispensing pipe, the dispensing valve is preferably held in the device by tightening of the joining element between the inner walls of the dispensing pipe. Furthermore, the feed valve and the dispensing valve can be linked by the joining element, the two valves and the joining element being integral and in a single piece and the two valves being held in the device by tightening of the joining element between the inner walls of the dispensing pipe.

In the case where the dispensing valve is held in the device according to the invention by tightening in the dispensing pipe, typically after a movement or insertion into the dispensing pipe, the dispensing valve is preferably held in the device according to the invention by tightening of the joining element in the dispensing pipe, typically after a movement or insertion of the dispensing valve into the dispensing pipe.

Furthermore, the device according to the invention can comprise a reservoir (preferably non-deformable or semi-rigid), so that the feed pipe links the reservoir to the deformable pouch. In this case, the device according to the invention can comprise a passage (for example grooves) arranged in order to allow air to pass from the dispensing pipe to the inside of the reservoir without passing through the pouch or through the feed pipe. This passage is preferably situated between an inner wall of the dispensing pipe and the joining element.

Furthermore, the feed valve can comprise a feed membrane comprising an end that is free with respect to the joining element, this free end being arranged in order to move so as to cause the feed valve to pass between its open and closed states and a part joining with the joining element.

Furthermore, the feed membrane can extend from its joining part to its free end at least in part in the dispensing direction.

Furthermore, the feed membrane can preferably be flat and extend from its joining part to its free end at an angle of less than 45° with respect with respect to the dispensing direction.

Furthermore, the feed membrane can extend from its joining part to its free end at an angle greater than 5° with respect to the dispensing direction. Preferably, this angle is comprised between 5° and 45°. Even more preferably, this angle is comprised between 5° and 20°.

Furthermore, the free end of the feed membrane (and preferably only the free end of the feed membrane, and not its joining part) can be located in the pouch.

Furthermore, the dispensing valve can comprise a dispensing membrane comprising an end that is free with respect to the joining element, this free end being arranged in order to move so as to cause the dispensing valve to pass between its open and closed states and a part joining with the joining element.

Furthermore, the dispensing membrane can extend from its joining part to its free end at least in part in the dispensing direction.

Furthermore, the dispensing membrane can preferably be flat and extend from its joining part to its free end at an angle of less than 45° with respect to the dispensing direction. Furthermore, this angle is preferably greater than 0.1°. Preferably, this angle is comprised between 0.1° and 45°. Even more preferably, this angle is comprised between 0.1° and 15°.

Furthermore, the free end of the dispensing membrane can be located in the dispensing pipe.

Furthermore, the dispensing device according to the invention can moreover comprise a return means integral with the membrane of the dispensing valve and supported on an inner wall of the dispensing pipe, arranged in order to exert a force on the dispensing membrane returning the dispensing valve from its open position to its closed position.

Furthermore, the joining part of the feed membrane can be further from the pouch than the joining part of the dispensing membrane.

Furthermore, the joining element can be situated between the dispensing and feed valves.

Furthermore, the dispensing pipe can comprise opposed inner walls becoming closer together, the nearer one gets to the dispensing valve (i.e., depending on the embodiment in question, the closer one gets to the joining element and/or the single piece).

Furthermore, the dispensing device according to the invention can moreover comprise an opening between the dispensing and feed pipes, said opening being plugged by the joining element.

Furthermore, the dispensing device according to the invention can moreover comprise guide means arranged in order to guide the free end of the feed membrane through the opening of the dispensing pipe into the pouch.

The dispensing device according to the invention can moreover comprise a closing valve situated in the dispensing pipe between the dispensing valve and an outlet of the dispensing pipe to the outside of the device according to the invention. The closing valve and the dispensing valve (optionally also with the feed valve) are preferably integral in a single piece.

According to another aspect of the invention, a method is proposed for manufacturing a fluid dispensing device according to the invention, characterized in that it comprises a step of insertion of the dispensing valve through the dispensing pipe and a step of moving this dispensing valve by sliding it in the dispensing pipe until the dispensing valve is positioned in order to obtain a device according to the invention, preferably until the dispensing valve is held in the device by tightening:

- for example by tightening by sliding the dispensing valve along the dispensing pipe,
- more particularly preferably by tightening in the dispensing pipe, preferably by a tightening between inner walls of the dispensing pipe (preferably, depending on the embodiment in question, until the dispensing valve is held in the device by tightening of the joining element between the inner walls of the dispensing pipe).

Furthermore, the insertion can comprise passing the feed valve from the dispensing pipe to the feed pipe through the opening.

Furthermore, the insertion can comprise the guiding, by the guide means, of the free end of the feed membrane through the opening of the dispensing pipe into the pouch.

DESCRIPTION OF FIGURES AND EMBODIMENTS

Other advantages and characteristics of the invention will become apparent on reading the detailed description of implementations and embodiments that are in no way limitative, and the attached drawings, in which.

Figure 7:
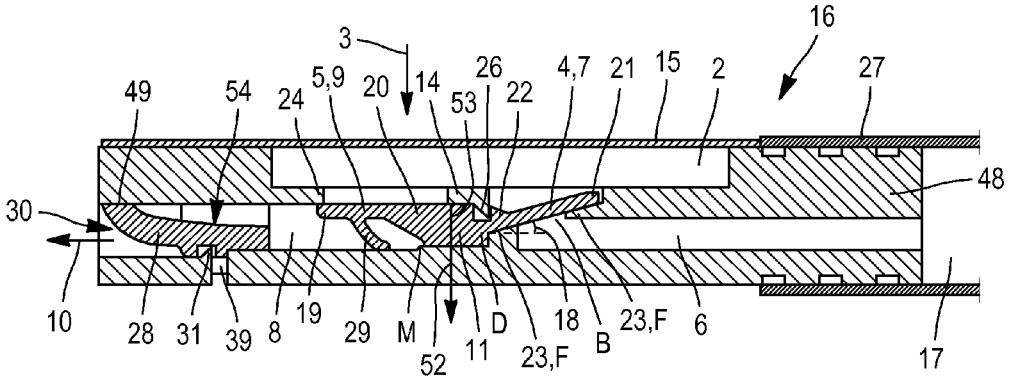
Figure 8:
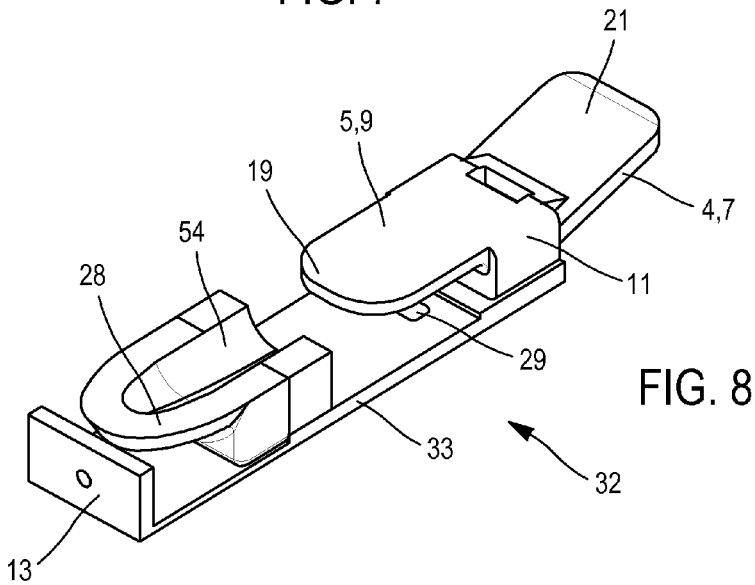
Figure 9:
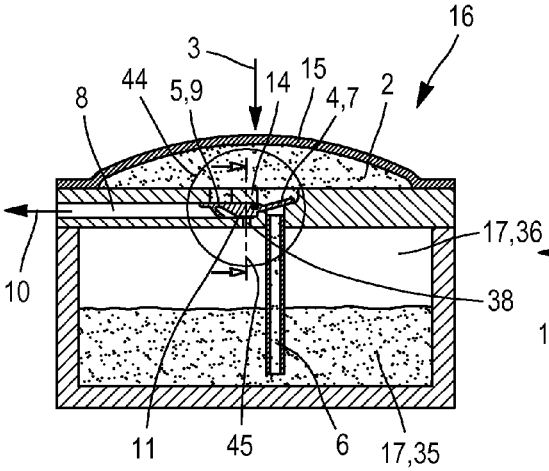
Figure 10:
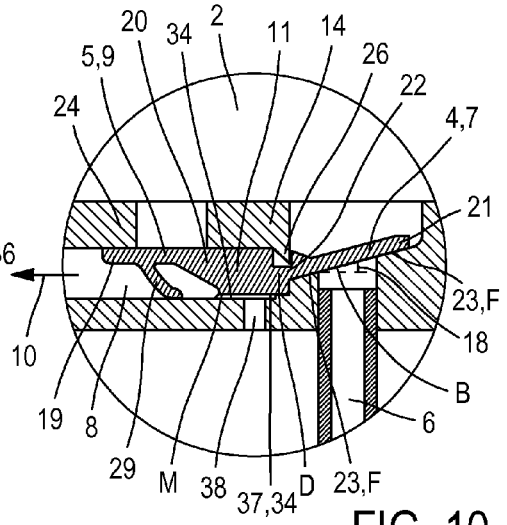
Figure 11:
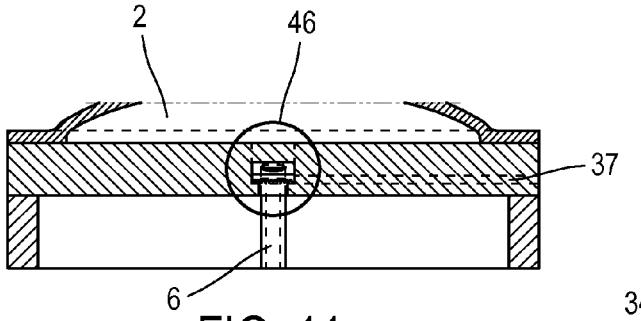
Figure 12:
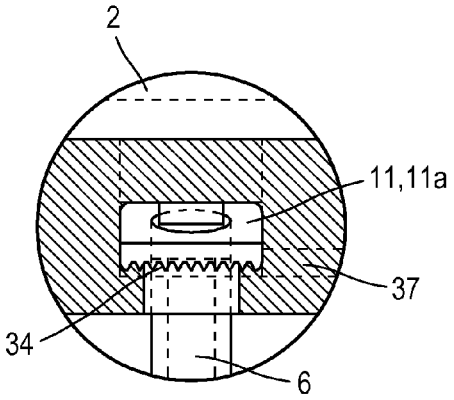
Figure 13:
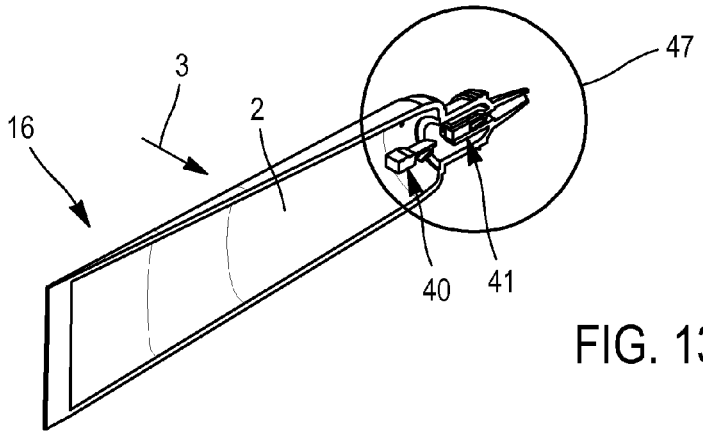
Figure 14:
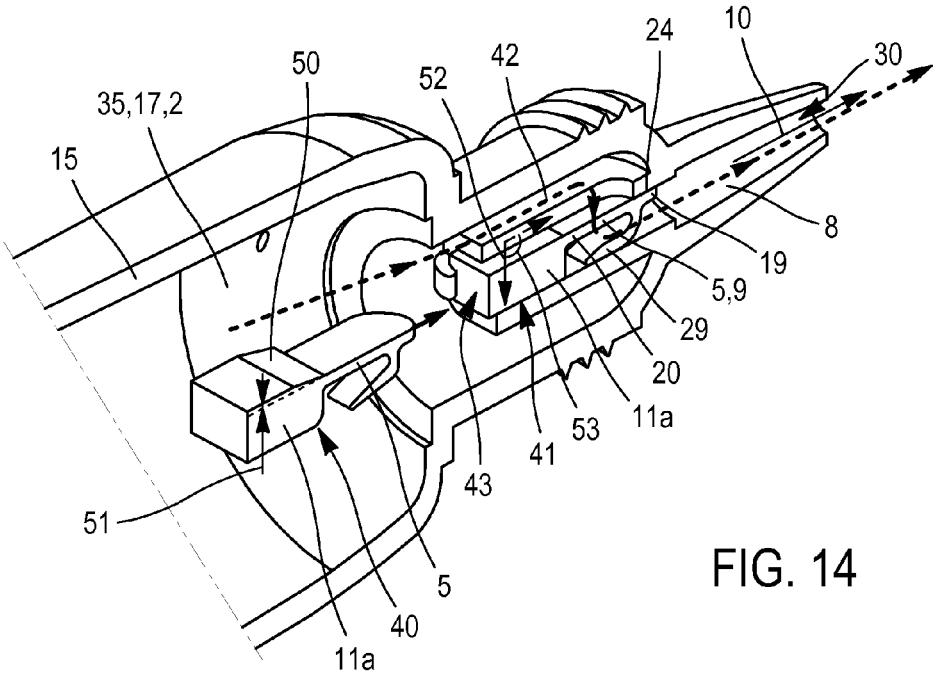

FIG. 7 is a cross-sectional profile view of a variant of device 16 according to the invention, FIG. 8 is a perspective view of valves 4, 5, 28 of the variant of FIG. 7, FIG. 9 is a cross-sectional profile view of another variant of device 16 according to the invention, FIG. 10 is an enlargement of the area 44 of FIG. 9, FIG. 11 is a cross-sectional view of a part of the variant of FIG. 9, according to the cross-sectional plane 45 of FIG. 9, FIG. 12 is an enlargement of area 46 of FIG. 11, FIG. 13 is a cross-sectional perspective view of another variant of device 16 according to the invention, this cross-section being produced according to a vertical cross-sectional plane which is a plane of symmetry of this variant of device 16, and FIG. 14 is an enlargement of area 47 of FIG. 13.

As these embodiments are in no way limitative, it is possible in particular to consider variants of the invention comprising only a selection of characteristics described below, in isolation from the other characteristics described (even if this selection is isolated within a sentence containing other characteristics), if this selection of characteristics is sufficient to confer a technical advantage or to differentiate the invention with respect to the prior art. This selection comprises at least one, preferably functional, characteristic without structural details, or with only a part of the structural details if this part alone is sufficient to provide a technical advantage or to distinguish the invention from the prior art.

A description will now be given with reference to FIGS. 1 to 5 of a fluid dispensing device 16 according to a preferred embodiment of the invention.

The fluid in the device 16 preferably comprises a liquid.

This fluid can consist either of a liquid or of a mixture of liquid and gas (for example a foam) or also of a gel.

The device 16 comprises:

- a reservoir 17 of this fluid,
- a feed pipe 6, directly linked to the reservoir 17 and arranged in order to convey in a dispensing direction 10 the fluid originating from the reservoir 17,
- a dispensing pipe 8 arranged in order to convey the fluid in the dispensing direction 10,
- a deformable pouch 2,
- a feed valve 4 which, in an open state, allows fluid to pass from the feed pipe 6 to the inside of the pouch 2, and, in a closed state, does not allow this, and
- a dispensing valve 5 which, in an open state, allows fluid to pass from the inside of the pouch 2 to the dispensing pipe 8 and, in a closed state, does not allow this.

The deformable pouch 2 is arranged in order to be deformed by pressure by pushing down in a pressure direction 3. It is also arranged in order to open or close the feed valve 4 or dispensing valve 5, depending on whether the pouch 2 is pushed or released.

In a closed state, the feed valve 4 prevents fluid from passing from the feed pipe 6 to the inside of the pouch 2.

In a closed state, the dispensing valve 5 prevents fluid from passing from the inside of the pouch 2 to the dispensing pipe 8.

The pouch is delimited by a rear wall 14 and a deformable lid 15.

The dispensing valve 5 is held in the device by tightening between inner walls of the dispensing pipe 8.

The feed pipe 6 extends along the dispensing direction 10.

The dispensing pipe 8 extends along the dispensing direction 10.

The feed pipe 6 and dispensing pipe 8 are extensions of one another, i.e. they extend along the same axis parallel to the dispensing direction 10.

The dispensing valve 5 is not on the side of the deformable pouch 2 but inside the dispensing pipe 8. The dispensing valve 5 is neither clipped nor welded but held by tightening between the inner walls of the dispensing pipe 8.

The feed valve 4 and the dispensing valve 5 are linked by a joining element 11. The two feed 4 and dispensing 5 valves and the joining element 11 are integral and in a single piece 12. This single 12 piece is monobloc. It is made of a single material. The production of the feed 4 and dispensing 5 valves as a single block makes it possible to reduce the time for insertion of these valves. There is no other tightening piece for tightening the feed 4 and dispensing 5 valves.

It is noted that the dispensing valve 5 is entirely contained in the dispensing pipe 8.

It is noted that the joining element 11 is entirely contained in the dispensing pipe 8 (considering the compression of this joining element 11).

Figure 1:
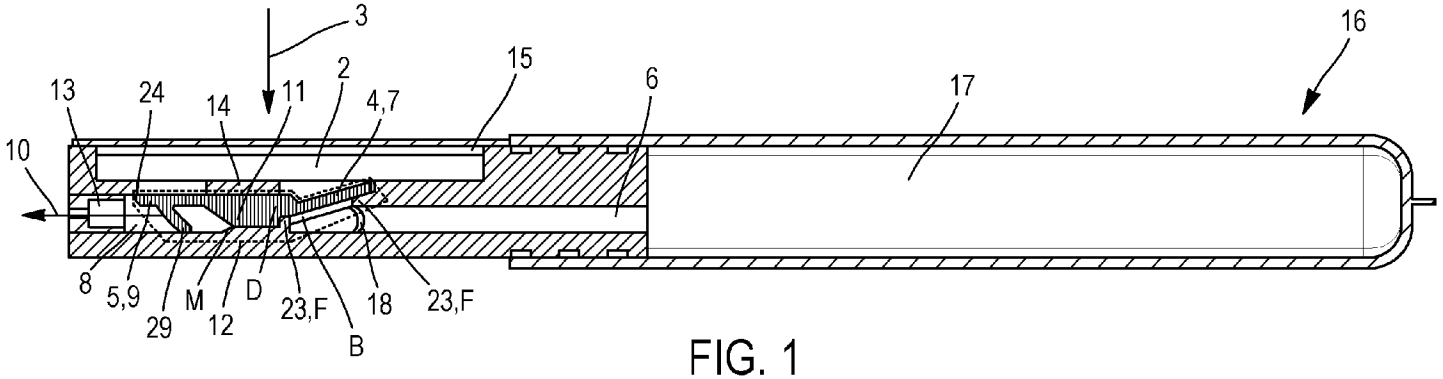
FIG. 1 is a cross-sectional profile view of a first embodiment of a device according to the invention.

The two feed 4 and dispensing 5 valves are held in the device 16 by tightening of the joining element 11 between the inner walls of the dispensing pipe 8. The tightening of the joining element 11 is a compression (i.e. a reduction of the section of the joining element 11 in a plane parallel to the view of FIG. 4, between a free position of the piece 12 before assembly in the device 16 and its assembled position inside the device 16 as illustrated in FIG. 1) typically comprised between 5% and 80%, preferably of the order of 25%+/−5%. The joining element 11 typically has a Shore A hardness of 70-80.

The feed valve 4 comprises a feed membrane 7. The feed membrane 7 comprises an end 21 that is free with respect to the joining element 11. This free end 21 is arranged in order to move so as to cause the feed valve 4 to pass between its open and closed states. The feed membrane 7 also comprises a part 22 joining with the joining element 11. This joining part 22 is situated in the feed pipe 6.

The dispensing valve 5 comprises a dispensing membrane 9. The dispensing membrane 9 comprises an end 19 that is free with respect to the joining element 11. This free end 19 is arranged in order to move so as to cause the dispensing valve 5 to pass between its open and closed states. The dispensing membrane 9 also comprises a part 20 joining with the joining element 11.

The joining part 20, 22 of each of the feed 4 and dispensing 5 valves joined to the joining element 11, and the joining element 11, are arranged on the side of the dispensing 8 and feed 6 pipes and not inside the pouch 2.

The feed membrane 7 extends from its joining part 22 to its free end 21. This extension is at least in part in the dispensing direction 10. The feed membrane 7 is flat. It extends from its joining part 22 to its free end 21 at an angle 18 preferably of less than 45° with respect to the dispensing direction 10.

The feed membrane 7 extends from its joining part 22 to its free end 21 at an angle preferably greater than 5° with respect to the dispensing direction 10.

This facilitates the arrangement of the free end of the feed membrane 7 in the pouch 2.

In a preferred embodiment of the device according to the invention, the angle between the feed membrane 7 and the dispensing direction 10 is 15°.

The free end 21 of the feed membrane 7 is located in the pouch 2 and not in the feed pipe 6. The free end 21 is the end which is not on the side of the joining element 11. The free end 21 can deform and/or move.

The joining part 22 of the feed membrane 7 is not located in the pouch 2. The joining part 22 is located on the side of the feed pipe 6 with respect to the rear wall 14.

The dispensing membrane 9 extends from its joining part to its free end. This extension is at least in part in the dispensing direction 10. The dispensing membrane 9 is flat. It extends from its joining part to its free end at an angle preferably of less than 15° with respect to the dispensing direction 10.

In a preferred embodiment of the device according to the invention illustrated in FIG. 1, the angle between the dispensing membrane 9 and the dispensing direction 10 is very slightly greater than 0° (typically between 0.1° and 1°). This very small angle is not perceptible in FIG. 1 but is sufficient to compress the dispensing valve 5 in its closed state for a good seal. In other variants, it is possible to have greater values of this angle (typically between 1° and 5°).

The free end 19 of the dispensing membrane 9 is located in the dispensing pipe 8 and not in the pouch 2. The free end 19 of the dispensing membrane 9 is the end which is not on the side of the joining element 11. The free end 19 of the dispensing membrane 9 can deform and/or move.

When the pouch 2 (more precisely, the lid 15) is pushed upon in the pressure direction 3, excess pressure is created in the pouch 2, and:

- the feed valve 4 (more precisely its free end 21) presses against the rear wall 14 inside the pouch 2 (more precisely, against a part of the rear wall called the feed seat 23) and is therefore held in its closed state, and
- the dispensing valve 5 (more precisely its free end 19) moves away from one wall of the dispensing pipe 8 and is thus held in its open state;

and the fluid contained in the pouch 2 passes through the dispensing valve 5 in the pressure direction 3 and is expelled from the device 16 by the dispensing pipe 8 in the dispensing direction 10.

When the pressure exerted on the pouch 2 (more precisely, on the lid 15) in the pressure direction 3 is released, a negative pressure is created in the pouch 2, and:

- the feed valve 4 (more precisely its free end 21) moves away from the rear wall 14 (more precisely, from its feed seat 23) inside the pouch 2 and is thus held in its open state, and
- the dispensing valve 5 (more precisely its free end 19) presses against an inner wall of the dispensing pipe 8 (more precisely, against a part of this inner wall called the dispensing seat 24) and is thus held in its closed state, and the fluid contained in the feed pipe 6 passes via the hole B through the feed valve 4 parallel to the pressure direction 3 and the pouch 2 is thus refilled with fluid originating from the reservoir 17 via the feed pipe 6.

When no pressure is exerted on the pouch 2 (more precisely, on the lid 15) in the pressure direction 3, the feed valve 4 and the dispensing valve 5 are both held in their closed state.

The device 16 also comprises a return means 29. The return means 29 is integral with the dispensing membrane 9 of the dispensing valve 5. It is supported on an inner wall of the dispensing pipe 5 and is arranged in order to exert a force on the dispensing membrane 9. This force returns the dispensing valve 5 from its open position to its closed position. Thus, the dispensing valve 5 is in the closed state when a variation of pressure on the pouch 2 is negative or zero.

Figure 5:
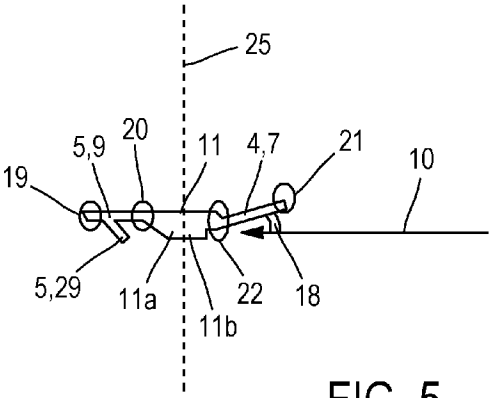
FIG. 5 is a profile view of the valves 4, 5 of the device of FIG. 1.

As illustrated in FIG. 5, at least part (preferably all) of the joining part 22 of the feed membrane 7 is further from the pouch 2 (or from the lid 15) than all the joining part 20 of the dispensing membrane 9. The joining element 11 is situated between the dispensing 5 and feed 4 valves.

Figure 2:
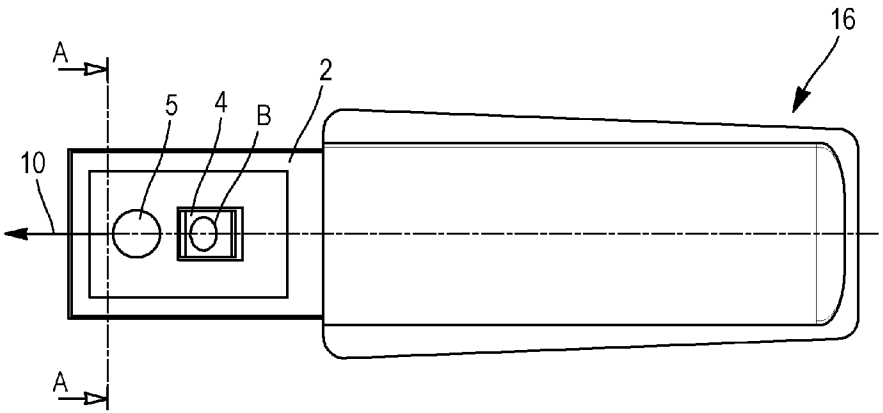
FIG. 2 is a top view of the device according to the invention in FIG. 1, without its pouch.
Figure 4:
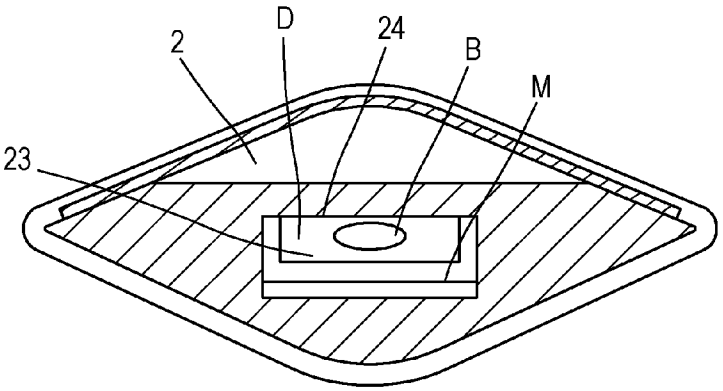
FIG. 4 is a cross-sectional frontal view of the device according to the invention of FIG. 1.
Figure 3:
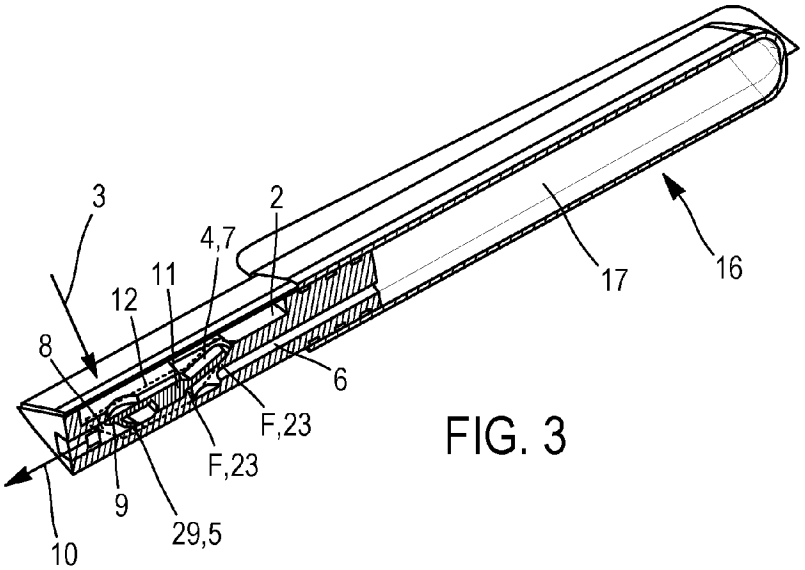
FIG. 3 is a perspective, cross-sectional view of the device according to the invention of FIG. 1.

FIG. 2 represents the cross-sectional plane A-A of FIG. 4. This cross-sectional plane A-A is perpendicular to the dispensing direction 10.

FIG. 4 is a frontal cross-sectional view of the device 16 according to the plane A-A shown in FIG. 2;

The inner walls of the dispensing pipe 8 are opposed and become closer together when getting nearer, parallel to the direction 10 (starting from one end of the dispensing pipe 8 opposite the feed pipe 6) to the single piece 12. The fact that these walls become closer together makes it possible to hold tight the joining element 11 between them.

The joining element 11 is held in the device 16 by tightening between inner walls of the dispensing pipe 8 at the level of a step M formed by these inner walls. This step M rises in the direction of the pouch 2.

The device 16 also comprises an opening D. The opening D is situated between the dispensing 8 and feed 6 pipes. The opening D (allowing the feed membrane 7 to pass through when it is assembled) is plugged by the joining element 11.

The step M is arranged in order to:

compress the joining element 11 for holding the dispensing valve 5, ensure the seal of the opening D between the feed pipe 6 and the dispensing pipe 8, so that fluid is not able to pass directly between the feed pipe 6 and the dispensing pipe 8 but has to pass via the pouch 2, lift the joining element 11 in the direction of the pouch 2.

The device 16 also comprises guide means F (comprising a plane inclined with respect to the dispensing direction 10) arranged in order to guide the free end 21 of the feed membrane 7 through the opening D of the dispensing pipe 8 into the pouch 2.

It is noted in FIG. 1 that at least part (preferably all) of the feed seat 23 is further from the lid 15 than is the dispensing seat 24.

The device 16 also comprises an (optional) outlet element 13 making it possible for example to transform a jet of fluid into spray. The outlet element 13 makes it possible to reduce the circumference of the dispensing pipe 8. The outlet element 13 is arranged on the side of one end of the dispensing pipe 8 opposite the feed pipe 6.

Figure 6:
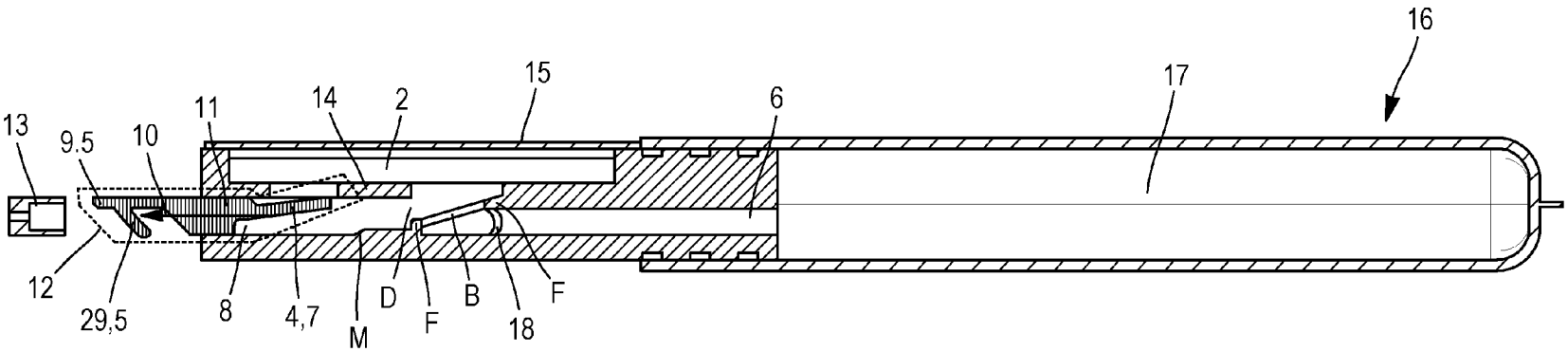
FIG. 6 is a view, according to the same cross-sectional profile as FIG. 1, of the device according to the invention illustrating its manufacturing method.

A method for manufacturing the fluid dispensing device 16 according to the invention is now described with reference to FIG. 6.

The method comprises a step of insertion of the dispensing valve 5 (i.e. preferably the single piece 12) through the dispensing pipe 8. The method also comprises a step of moving this dispensing valve 5 (i.e. preferably the single piece 12) parallel to the dispensing direction 10 in the dispensing pipe 8 until the dispensing valve 5 (i.e. preferably the single piece 12) is positioned in order to obtain the device 16 as described previously with reference to FIGS. 1 to 5, i.e. until the joining element 11 plugs the opening D and/or until the dispensing valve 5 is held in the device by tightening (of the joining element 11) between inner walls of the dispensing pipe 8.

The movement of the dispensing valve 5 (preferably the single piece 12) is carried out by sliding the dispensing valve 5 (preferably the single piece 12) in the dispensing pipe 8.

The step M makes it possible to finalize the tightening of the dispensing valve 5 (more precisely of the joining element 11) during the assembly of the device 16, so that the sliding of the dispensing valve 5 in the dispensing pipe 8 comprises, at the level of the step M, a movement of the dispensing valve 5 in the direction of the pouch 2 (i.e. to its seat). This makes it possible to ensure a good seal.

The insertion step comprises passing the feed valve 4 from the dispensing pipe 8 to the feed pipe 6 via the opening D. This step of insertion comprises the guiding, by the guide means F, of the free end 21 of the feed membrane 7 through the opening D from the dispensing pipe 8 into the pouch 2.

The outlet element 13 is finally inserted into the device 16, on the side of one end of the dispensing pipe 8 opposite the feed pipe 6.

Of course, the invention is not limited to the examples which have just been described, and numerous adjustments can be made to these examples without exceeding the scope of the invention.

For example, the feed 4 and dispensing 5 valves can be spaced out and not integral without exceeding the scope of the invention. In different variables, that can optionally be combined with each other:

1) the feed valve 4 can be linked to the reservoir 17 and form a single piece;

2) the dispensing valve 5 can be integral with the joining element 11 as described previously, without this joining element 11 necessarily being integral with the feed valve 4. In this case, the dispensing valve 5 is held in the device 16 by tightening of the joining element 11 between inner walls of the dispensing pipe 8. The feed valve 4 can be fixed by any other means, for example fixed by clipping, assembling it by "the top" passing from the side of the pouch 2, even if is true that this variant is less advantageous than that shown in FIG. 1. Thus, with reference to FIG. 5, it is possible to envisage the joining element 11 being made of two separate (and preferably not integral) elements 11*a* and 11*b*, the dispensing valve 5 being integral with the joining element 11*a*, the feed valve 4 being integral with the joining element 11*b* (the cutting line 25 illustrates this possible separation). The dispensing valve 5 is then held in the device 16 by tightening the joining element 11*a* between inner walls of the dispensing pipe 8. The feed valve 4 can then preferably be held in the device 16 by tightening of the joining element 11*b* between inner walls of the feed pipe 6;

3) the device 16 can comprise several dispensing and/or feed valves (for example for dispensing several fluids), these dispensing and feed valves preferably comprising at least one pair constituted by a dispensing valve and a feed valve, the valves of each pair being either integral, for example in the form of a single piece 12 as described previously, or separate as described in point 2) above. In the case of two fluids to be dispensed, the device 16 can comprise two dispensing valves carried by an insert supporting these two dispensing valves, the assembly formed by these two dispensing valves and by the insert preferably being assembled by tightening in an outlet pipe into which the dispensing pipes of each of these dispensing valves open, and at least one, preferably each of these dispensing valves, is held by tightening in its dispensing pipe on the same principle as described with reference to Figures.

4) the lid 15 and the wall 27 of the reservoir 17 can be made in a single piece (a single material). In particular, the body of pump 48 can be inserted into a single-walled or double-walled tube, for example by co-extrusion.

A description will now be given, with reference to FIGS. 7 to 14, of different variants of device 16 according to the invention. These variants will be described only as regards their differences with respect to the embodiment of FIGS. 1 to 6. In particular, the reference signs already introduced will not be described again in full.

With reference to FIGS. 7 and 8, it is noted that a variant of device 16 according to the invention moreover comprises a tooth or protuberance 26 arranged in order to be pushed into the joining element 11 (or into the element 11*a*). Thus, this tooth or protuberance 26 prevents the dispensing valve 5 from sliding inside the dispensing pipe 8.

The tightening forces exerted by the dispensing pipe 8 on the element 11 have a component perpendicular to the inner walls of the dispensing pipe 8 in contact with the element 11, the combination 52 of all of the components of these tightening forces being preferably substantially perpendicular to the inner walls of the pipe 8 in contact with the element 11 (or perpendicular to the dispensing direction 10) or at least forming an angle 53 greater than 45° with respect to the inner walls of the pipe 8 in contact with the element 11 (or with respect to the dispensing direction 10). Moreover, still with reference to FIGS. 7 and 8, it is noted that a variant of device 16 according to the invention moreover comprises a closing valve 28 situated in the dispensing pipe 8 between the dispensing valve 5 and the outlet 30 of the dispensing pipe 8 to the outside of the device 16. This closing valve 28 has:

- an open state, which allows fluid to pass from the dispensing pipe 8 to the outside of the device 16, and
- a closed state, which prevents the fluid from passing from the dispensing pipe 8 to the outside of the device 16.

The valve 28 is held while itself being compressed and deformed in the dispensing pipe 8, in this variant by the walls of the pipe 8 which become closer together as described previously.

When the pouch 2 (more precisely, the lid 15) is pushed upon in the pressure direction 3, excess pressure is created in the pouch 2, and the closing valve 28 moves away from its seat 49 (which is a wall of the dispensing pipe 8) and is thus held in its open state.

When the pressure exerted on the pouch 2 (more precisely, on the lid 15) in the pressure direction 3 is released, a negative pressure is created in the pouch 2, and the closing valve 28 presses against its seat 49 (which is an inner wall of the dispensing pipe 8) and is thus held in its closed state.

This allows a better seal of the device 16 in particular in order to prevent drying of the fluid in the pipe 8.

The device 16 preferably comprises a tooth or protuberance 31 arranged in order to be pushed into the valve 28.

Thus, this tooth or protuberance 31 prevents the dispensing valve 5 from sliding inside the dispensing pipe 8.

The tooth 31 is produced by piercing a hole 39 through the device 16 into the dispensing pipe 8. Once the valve 28 is in place in the pipe 8, the hole 39 is plugged by the valve 28.

With reference to FIG. 8, the closing valve 28 and the dispensing valve 5 (optionally also with the feed valve 4) are preferably integral in a single piece 32. This piece 32 is preferably produced by bi-injection of a first and of a second material. The piece 32 comprises:

- a support part, made of the first (rigid) material, preferably comprising:
  - a plate 33 delimiting a lower wall of the dispensing pipe 8 and/or
  - a stopper 13 (outlet reduction, in "applicator" form or means for generating a spray of the fluid), and
- the valves 28, 5 (and optionally 4) made of the second material (more flexible than the first material).

It is noted that the valve 28 comprises a concave channel 54 arranged in order to allow the fluid to pass when the valve 28 is in its open state.

With reference to FIGS. 9 to 12, it is noted that an "atmospheric" variant of device 16 according to the invention comprises a passage 34 (for example grooves):

- situated between the inner walls of the dispensing pipe 8 and the element 11 or 11*a* (more precisely between the step M and the element 11 or 11*a*), and
- arranged in order to allow air to pass from the dispensing pipe 8 to the inside of the reservoir 17 without passing through the pouch 2, even when the pressure exerted on the pouch 2 (more precisely, on the lid 15) in the pressure direction 3 is released.

Thus in this variant, the device 16 is no longer airtight.

Grooves made under the element 11 or 11*a* in the extension of the dispensing channel make it possible, with the deformation of a flexible part of the material of the element 11 or 11*a*, to create micro-channels. These micro-channels are at the base of the grooves (hollows).

The valves 4, 5 are leakproof in order to prevent leakages of the fluid 35 (which can consist either of a liquid or of a mixture of liquid and gas (for example a foam) or also of a gel) from the pouch 2 to the outside of the device 16.

On the other hand, the dispensing valve 5 is no longer airtight, so that:

- when the pouch 2 (more precisely, the lid 15) is pushed upon in the pressure direction 3, excess pressure is created in the pouch 2, so as to expel fluid 35 from the pouch 2 to the dispensing pipe 8 then to the outside of the device 16, but
- when the pressure exerted on the pouch 2 (more precisely, on the lid 15) in the pressure direction 3 is released:
  - fluid 35 is sucked from the reservoir 17 to the feed pipe 6 then to the pouch 2, and
  - air 36 passes from the outside of the device 16 to the dispensing pipe 8 and/or to another dedicated pipe 37, then to the passage 34 then to a hole 38 then to the reservoir 17 (without passing through the pouch 2 or through the feed pipe 6 or through the feed valve 4), so that, in the reservoir 17, air 36 replaces fluid 35 sucked from the reservoir 17 to the pouch 2.

The passage 34 typically consists of grooves of microscopic height (typically between 50 and 600 μm) forming micro-channels.

Finally, with reference to FIGS. 13 and 14, it is noted that a variant of device 16 according to the invention may not comprise a feed valve 4.

In this variant, the feed pipe 6, the reservoir 17 and the pouch 2 are merged (unlike the previous variants and embodiments in which these elements were clearly separate).

When the pouch 2 is pushed upon in the pressure direction 3, excess pressure is created in the pouch 2, and the dispensing valve 5 (more precisely its free end 19) moves away from a wall of the dispensing pipe 8 and is thus held in its open state; and the fluid 35 contained in the pouch 2 passes through the dispensing valve 5 along the path 42 and is expelled from the device 16 via the dispensing pipe 8 in the dispensing direction 10.

When the pressure exerted on the pouch 2 (more precisely, on the lid 15) in the pressure direction 3 is released, a negative pressure is created in the pouch 2, and the dispensing valve 5 (more precisely its free end 19) presses against an inner wall of the dispensing pipe 8 (more precisely, against a part of this inner wall called the dispensing seat 24) and is thus held in its closed state without air being able to return from the outside of the device 16 to the inside of the pouch 2.

The method for manufacturing this variant of device 16 comprises a step of insertion of the dispensing valve 5 via the dispensing pipe 8 and a step of movement of this dispensing valve 5 by sliding it in the dispensing pipe 8 until the dispensing valve is held in the device 16 by tightening between inner walls of the dispensing pipe 8 (i.e. by tightening forces exerted by the dispensing pipe 8 on the valve 5 or on the element 11*a*, these tightening forces having a component perpendicular to the inner walls of the dispensing pipe 8 in contact with the valve 5 or the element 11*a* respectively, the combination 52 of all of the components of these tightening forces being preferably substantially perpendicular to the inner walls of the pipe 8 in contact with the valve 5 or the element 11*a* respectively (or perpendicular to the dispensing direction 10) or at least forming an angle 53 greater than 45° with respect to the inner walls of the pipe 8 in contact with the valve 5 or the element 11*a* respectively (or with respect to the dispensing direction 10)).

Each of FIGS. 13 and 14 illustrates two positions of the dispensing valve:

- a first position 40 before the insertion of the dispensing valve 5 into the dispensing pipe 8, and
- a second position 41 at the end of the insertion of the dispensing valve 5 into the dispensing pipe 8.

However:

- unlike the case of FIGS. 1 to 12 in which the dispensing valve 8 was inserted via the dispensing pipe 8 on the side of the outlet 30 forming the join between the dispensing pipe 8 and the outside of the device 16,
- here, in the case of the variant of FIGS. 13 and 14, the dispensing valve 8 is inserted via the dispensing pipe 8 on the side of the inlet 43 forming the join between the dispensing pipe 8 and the pouch 2.

This valve 5 is integral with the joining element 11*a* which has a slope 50 which increases when the valve 5 enters the dispensing pipe 8 via the rear 43. This slope 50 allows the progressive compression of the material of the element 11*a* during its introduction by sliding along the dispensing pipe 8. The material thus compressed allows tightening with the dispensing pipe 8. The amplitude 51 of the deformation is typically of the order of 0.1 to 0.4 mm.

It is noted that in all of the embodiments, the dispensing membrane 9 and the joining element 11 or 11*a* (which is integral with the dispensing membrane 9) are situated side by side along the dispensing direction 10.

It is noted moreover that the seat 24 is limited to one, preferably flat, face of the dispensing pipe 8, and does not fully encircle a section of the dispensing pipe 8 which would be realized in a plane perpendicular to the dispensing direction 10.

Of course, the different characteristics, forms, variants and embodiments of the invention can be combined with one another.

The invention claimed is:

1. A device for dispensing a fluid; comprising:

a dispensing pipe arranged in order to convey a fluid in a dispensing direction, a deformable pouch, a dispensing valve, which, in an open state, allows fluid to pass from the inside of the pouch to the dispensing pipe, and, in a closed state, does not allow this, wherein the dispensing valve is held in the device by tightening between inner walls of the dispensing pipe.

2. The device according to claim 1, wherein it further comprises:

a feed pipe, a feed valve, which, in an open state, allows fluid to pass from the feed pipe to the inside of the pouch, and, in a closed state, does not allow this.

3. The device according to claim 2, wherein the dispensing valve is linked to a joining element, the dispensing valve and the joining element being integral and in a single piece, the dispensing valve being held in the device by tightening of the joining element between the inner walls of the dispensing pipe, and wherein the feed valve and the dispensing valve are linked by the joining element, the two valves and the joining element being integral and in a single piece and the two valves being held in the device by tightening of the joining element between the inner walls of the dispensing pipe.

4. The device according to claim 3, wherein the feed valve comprises a feed membrane comprising:

an end that is free with respect to the joining element, this free end being arranged in order to move so as to cause the feed valve to pass between its open and closed states and a part joining with the joining element.

5. The device according to claim 4, wherein the feed membrane is flat and extends from its joining part to its free end at an angle comprised between 5° and 45° with respect to the dispensing direction.

6. The device according to claim 4, wherein the free end of the feed membrane is located in the pouch.

7. The device according to claim 4, wherein the dispensing valve is linked to the joining element, the dispensing valve and the joining element being integral and in a single piece, the dispensing valve being held in the device by tightening of the joining element between the inner walls of the dispensing pipe, wherein the device moreover comprises an opening (D) between the dispensing and feed pipes, said opening (D) being plugged by the joining element, and wherein the device comprises guide means (F) arranged in order to guide the free end of the feed membrane through the opening (D) of the dispensing pipe into the pouch.

8. The device according to claim 2, wherein the dispensing valve is linked to a joining element, the dispensing valve and the joining element being integral and in a single piece, the dispensing valve being held in the device by tightening of the joining element between the inner walls of the dispensing pipe, and wherein the device moreover comprises an opening (D) between the dispensing and feed pipes, said opening (D) being plugged by the joining element.

9. The device according to claim 2, wherein it comprises a reservoir, so that the feed pipe links the reservoir to the deformable pouch.

10. The device according to claim 9, wherein it comprises a passage arranged in order to allow air to pass from the dispensing pipe to the inside of the reservoir without passing through the pouch or through the feed pipe.

11. The device according to claim 1, wherein the dispensing pipe comprises opposed inner walls becoming closer together the nearer one gets to the dispensing valve.

12. The device according to claim 1, wherein the dispensing valve is linked to a joining element, the dispensing valve and the joining element being integral and in a single piece, the dispensing valve being held in the device by tightening of the joining element between the inner walls of the dispensing pipe.

13. The device according to claim 12, wherein the dispensing valve comprises a dispensing membrane comprising:

an end that is free with respect to the joining element, this free end being arranged in order to move so as to cause the dispensing valve to pass between its open and closed states and a part joining with the joining element.

14. The device according to claim 13, wherein the dispensing membrane is flat and extends from its joining part to its free end at an angle comprised between 0.1 and 45° with respect to the dispensing direction.

15. The device according to claim 13, wherein the feed valve comprises a feed membrane comprising:

an end that is free with respect to the joining element, this free end being arranged in order to move so as to cause the feed valve to pass between its open and closed states and a part joining with the joining element, and wherein the joining part of the feed membrane is further from the pouch than the joining part of the dispensing membrane.

16. The device according to claim 1, wherein it moreover comprises a closing valve situated in the dispensing pipe between the dispensing valve and an outlet of the dispensing pipe to the outside of the device.

17. The device according to claim 16, wherein the closing valve and the dispensing valve are integral in a single piece.

18. A method for manufacturing a fluid dispensing device according to claim 1, wherein it comprises a step of insertion of the dispensing valve via the dispensing pipe and a step of moving this dispensing valve by sliding it in the dispensing pipe until the dispensing valve is held in the device by tightening between inner walls of the dispensing pipe.

19. A method according to claim 18, wherein the device further comprises: a feed pipe, a feed valve, which, in an open state, allows fluid to pass from the feed pipe to the inside of the pouch, and, in a closed state, does not allow this, and the dispensing valve is linked to a joining element, the dispensing valve and the joining element being integral and in a single piece, the dispensing valve being held in the device by tightening of the joining element between the inner walls of the dispensing pipe, and wherein the device further comprises: an opening (D) between the dispensing and feed pipes, said opening (D) being plugged by the joining element, wherein the step of insertion comprises passing the feed valve from the dispensing pipe to the feed pipe via the opening (D).

20. A method according to claim 18, wherein the device further comprises: a feed pipe, a feed valve, which, in an open state, allows fluid to pass from the feed pipe to the inside of the pouch, and, in a closed state, does not allow this, wherein the dispensing valve is linked to a joining element, the dispensing valve and the joining element being integral and in a single piece, the dispensing valve being held in the device by tightening of the joining element between the inner walls of the dispensing pipe, wherein the feed valve and the dispensing valve are linked by the joining element, the two valves and the joining element being integral and in a single piece and the two valves being held in the device by tightening of the joining element between the inner walls of the dispensing pipe, wherein the feed valve comprises a feed membrane comprising: an end that is free with respect to the joining element, this free end being arranged in order to move so as to cause the feed valve to pass between its open and closed states and a part joining with the joining element, wherein the dispensing valve is linked to the joining element, the dispensing valve and the joining element being integral and in a single piece, the dispensing valve being held in the device by tightening of the joining element between the inner walls of the dispensing pipe, wherein the device moreover comprises an opening (D) between the dispensing and feed pipes, said opening (D) being plugged by the joining element, and wherein the device comprises guide means (F) arranged in order to guide the free end of the feed membrane through the opening (D) between the dispensing and feed pipes into the pouch, the step of insertion comprises a guiding, by the guide means, of the free end of the feed membrane through the opening (D) between the dispensing and feed pipes into the pouch.

* * * * *